US006071178A

United States Patent [19]

Baker, III

[11] Patent Number: 6,071,178

[45] Date of Patent: Jun. 6, 2000

[54] SCORED POLISHING PAD AND METHODS RELATED THERETO

[75] Inventor: Arthur Richard Baker, III, Wilmington, Del.

[73] Assignee: Rodel Holdings Inc., Newark, Del.

[21] Appl. No.: 09/109,688

[22] Filed: Jul. 2, 1998

Related U.S. Application Data

[60] Provisional application No. 60/051,655, Jul. 3, 1997.

[51] Int. Cl.[7] ..... B24B 1/00

[52] U.S. Cl. ..... 451/36; 451/41; 451/59; 451/63

[58] Field of Search ..... 451/41, 59, 63, 451/527, 36, 529, 530, 533, 550

[56] References Cited

U.S. PATENT DOCUMENTS

| | | | |
|---|---|---|---|
| 4,111,666 | 9/1978 | Kalbow | 451/527 |
| 5,177,908 | 1/1993 | Tuttle | 451/527 |
| 5,212,910 | 5/1993 | Breivogel et al. . | |
| 5,216,843 | 6/1993 | Breivogel et al. | 451/550 |
| 5,287,663 | 2/1994 | Pierce et al. . | |
| 5,489,233 | 2/1996 | Cook et al. | 451/527 |
| 5,876,269 | 3/1999 | Torii . | |

*Primary Examiner*—Timothy V. Eley
*Assistant Examiner*—Willie Berry, Jr.
*Attorney, Agent, or Firm*—Konrad Kaeding; Kenneth Benson

[57] ABSTRACT

A polishing pad is provided comprising an upper surface and a lower surface, substantially parallel to one another, wherein the pad has enhanced flexibility produced by scoring of either or both surfaces. The pad thickness is generally greater than 500$\mu$. The scoring creates slits having a depth of less than 90% of the thickness.

17 Claims, No Drawings

SCORED POLISHING PAD AND METHODS RELATED THERETO

This application claims the benefit of U.S. Provisional Application No. 60/051,655 filed Jul. 3, 1997.

BACKGROUND OF THE INVENTION

1. Field of the Invention

The present invention relates generally to polishing pads useful in the manufacture of semiconductor devices or the like. More particularly, the polishing pads of the present invention provide improved planarization from a single pad layer.

2. Discussion of the Related Art

U.S. Pat. No. 5,281,663 describes a polishing pad containing a rigid layer adjacent to a polishing layer. The rigid layer imparts a controlled rigidity to the polishing layer. The resilient layer provides substantially uniform pressure to the rigid layer. During operation, the rigid layer and the resilient layer apply an elastic flexure pressure to the polishing layer to induce controlled flex in the polishing layer to conform to the global topography of the wafer surface while maintaining a controlled rigidity over the local topography of the wafer surface.

U.S. Pat. No. 5,212,910 describes an improved composite polishing pad that includes a first layer of elastic material, a second stiff layer and a third layer optimized for slurry transport. This third layer is the layer against which the wafer makes contact during the polishing process. The second layer is segmented into individual sections physically isolated from one another in the lateral dimension. Each segmented section is resilient across its width yet cushioned by the first layer in the vertical direction. The physical isolation of each section combined with the cushioning of the first layer of material create a sort of "bedspring" effect which enables the pad to conform to longitudinal gradations across the wafer.

Rigid polishing pads are generally used to obtain the degree of planarity necessary. Such rigid pads however, do not conform to surface height variations. Therefore, a need exists for a polishing pad exhibiting the planarization capabilities of a rigid pad and the ability to conform to surface features found in a softer pad.

SUMMARY OF INVENTION

The present invention is directed to a polishing pad comprising an upper surface and lower surface, substantially parallel to one another. The pad has enhanced flexibility produced by scoring of either or both surfaces. The pad thickness is generally greater than 500$\mu$. The scoring creates slits having a depth of less than 90% of said pad thickness.

DETAILED DESCRIPTION OF THE PREFERRED EMBODIMENTS

The present invention is directed to an improved polishing pad useful in the polishing or planarization of substrates, particularly substrates for the manufacture of semiconductor devices or the like. The articles and methods of the present invention may also be useful in other industries and can be applied to any one of a number of materials, including, but not limited to, silicon, silicon dioxide, metal, dielectrics, ceramics and glass.

Surface planarization is generally necessary in manufacturing semiconductor devices. Poor localized surface planarity can cause low yield. In addition, devices formed on the edge of semiconductor wafers have a low yield rate due to reasons discussed below.

Typically a wafer's edge portion does not possess sufficient planarity to form a functional device. This phenomenon is know as the "edge effect". The edge effect is caused by non-uniform surface removal during polishing. The wafer's non-usable portion that results from the edge effect is called the "exclusion region". Generally, the exclusion region size is dependent, at least in part, on the polishing pad properties. A pad's compressive stiffness can affect both the exclusion region's magnitude and width. Pad thickness also has an effect on the exclusion region's size. Localized planarity can also be dependent, at least in part, upon pad stiffness. The present invention generally reduces such edge effect and typically improves overall planarity, thereby increasing yield during semiconductor manufacturing.

Pads of the present invention provide flexibility to compensate for height variations, yet possess the firmness necessary for good planarity. In general, flexible polishing pads are capable of conforming to height variations but provide low removal rates and typically less than optimal planarity. More rigid pads tend not to conform to surface features but generally provide good planarity. Rigid and non-rigid pads have been layered to obtain the benefits of both types of pads. Layered pads, however, generally have uniform stiffness throughout. Pads of the present invention are stiff for short lengths thereby optimizing local planarization, while providing flexibility along certain longer lengths, thereby allowing the pad to conform to surface edges, thus reducing edge effect. In this way the pads of the present invention provide the advantages of both rigid and non-rigid pads. Pads of the present invention generally have increased flexibility in a range of 2 mm or longer while generally remaining relatively rigid over shorter distances.

Any type of pad may be modified to form a pad according to the present invention. The preferred pad thickness is between 0.5 mm and 5 mm. Preferably pad materials are sufficiently hydrophilic to provide a critical surface tension greater than or equal to 34 milliNewtons per meter, more preferably greater than or equal to 37 milliNewtons per meter and most preferably greater than or equal to 40 milliNewtons per meter. Critical surface tension defines the wettability of a solid surface by noting the lowest surface tension a liquid can have and still exhibit a contact angle greater than zero degrees on that solid. Thus, polymers with higher critical surface tensions are more readily wet and are therefore more hydrophilic. Critical surface tension of common polymers are provided below:

| Polymer | Critical Surface Tension (mN/m) |
|---|---|
| Polytetrafluoroethylene | 19 |
| Polydimethylsiloxane | 24 |
| Silicone Rubber | 24 |
| Polybutadiene | 31 |
| Polyethylene | 31 |
| Polystyrene | 33 |
| Polypropylene | 34 |
| Polyester | 39–42 |
| Polyacrylamide | 35–40 |
| Polyvinyl alcohol | 37 |
| Polymethyl methacrylate | 39 |
| Polyvinyl chloride | 39 |
| Polysulfone | 41 |

-continued

| Polymer | Critical Surface Tension (mN/m) |
|---|---|
| Nylon 6 | 42 |
| Polyurethane | 45 |
| Polycarbonate | 45 |

In one embodiment, the pad material is derived from at least:

1. an acrylated urethane;
2. an acrylated epoxy;
3. an ethylenically unsaturated organic compound having a carboxyl, benzyl, or amide functionality;
4. an aminoplast derivative having a pendant unsaturated carbonyl group;
5. an isocyanurate derivative having at least one pendant acrylate group;
6. a vinyl ether,
7. a urethane
8. a polyacrylamide
9. an ethylene/ester copolymer or an acid derivative thereof;
10. a polyvinyl alcohol;
11. a polymethyl methacrylate;
12. a polysulfone;
13. an polyamide;
14. a polycarbonate;
15. a polyvinyl chloride;
16. an epoxy;
17. a copolymer of the above; or
18. a combination thereof.

Preferred pad materials comprise urethane, carbonate, amide, sulfone, vinyl chloride, acrylate, methacrylate, vinyl alcohol, ester or acrylamide moieties. The pad material can be porous or non-porous. In one embodiment, the material is non-porous; in another embodiment, the material is non-porous and free of fiber reinforcement.

Manufacturing techniques may include, but are not limited to, molding, casting, printing, sintering, skiving, felting, coating, foaming or the like.

Pad flexibility necessary for the pad to conform to variations in height, is created by scoring the top surface, bottom surface, or both surfaces. By adjusting the spacing, depth, width, length and pattern of the cuts, the pad properties can be optimized for particular applications.

Scoring increases pad flexibility even for very rigid materials. Pad stiffness is dependent in part upon the cross-sectional moment of inertia. Pads useful for the polishing of semiconductor wafers generally have a pad moment of inertia between about 0.011 $mm^4$ and about 10.9 $mm^4$ per mm of distance across the pad before scoring of the pad surface(s). Pad stiffness decreases as the pad moment of inertia decreases. Scoring the pad has been found to generally reduce the pad moment of inertia by decreasing pad thickness in certain areas, thereby rendering the pad more flexible. Pad stiffness also relates to the depth of cuts. The deeper the cuts, the less stiff the pad will generally be. The desired depth of cuts depends on the pad material, type of surface to be polished and the polishing conditions. In one embodiment of the present invention, a 2.0 mm thick pad is scored on the bottom to a depth of 0.08 mm.

It should be noted that cuts, grooves, indentations or the like generated for conditioning of a pad are typically shallower than cuts made according to the present invention. The depth of conditioning indentations generally represents a smaller percent of pad thickness than cuts made to reduce stiffness. Typically cuts to reduce stiffness are 5–80% of pad thickness. They are preferably less than 90% of the pad thickness so that sufficient pad integrity is maintained. Cuts, grooves, indentations or the like designed to enhance or facilitate polishing fluid flow are generally more than 100$\mu$ wide which is wider than the cuts made according to the present invention.

The spacing of cuts determines the length scale over which the relative bending stiffness of the pad is reduced. Increased spacing provides longer planarization lengths. Decreased spacing reduces edge effect.

Slit spacing can be periodic, aperiodic or random. Under some conditions, periodic spacing may impart a pattern to the wafer. Therefore, random or aperiodic patterning is preferred. The pad will planarize a surface over a length that is slightly less than the spacing between slits. Typically the spacing between slits will be in the range of 0.02 cm to 5 cm.

According to the present invention cut pads may be attached to pads of lower compressive stiffness to enable the cut pad to flex after attachment to polishing apparatus.

The method of polishing or planarizing a workpiece such as a semiconductor wafer genrally comprises providing a polishing pad, placing a polishing fluid into the interface between the workpiece and the pad, and having the workpiece and pad move in relation to one another thereby polishing or planarizing the workpiece. This invention provides improved pads for this method.

Nothing from the above discussion is intended to be a limitation of any kind with respect to the present invention. All limitations to the present invention are intended to be found only in the claims, as provided below.

What is claimed is:

1. A polishing pad comprising an upper surface for polishing a workpiece and a lower surface substantially parallel to the upper surface, said polishing pad having enhanced flexibility produced by slits in said lower surface, said pad having a thickness of greater than 500$\mu$, said slits having a depth of less than 90% of said pad thickness.

2. A pad in accordance with claim 1 wherein the pad has a moment of inertia which is less than 10.9 $mm^4$ per mm of distance across the pad surface.

3. A pad in accordance with claim 1 wherein the depth of the slits is at least 20% of said pad thickness.

4. A pad in accordance with claim 1 wherein the depth of the slits is at least 5% of said pad thickness.

5. A pad in accordance with claim 1 wherein spacing between slits is between 5 cm and 0.02 cm.

6. A pad in accordance with claim 1 wherein spacing between slits is random.

7. A pad in accordance with claim 1 wherein spacing between slits is periodic.

8. A pad in accordance with claim 1 wherein spacing between slits is aperiodic.

9. A polishing pad comprising an upper surface for polishing a substrate and a lower surface substantially parallel to the upper surface, said polishing pad having enhanced flexibility produced by slits in said upper surface and said lower surface, said pad having a thickness of greater than 500$\mu$, said slits having a depth of less than 90% of said pad thickness.

10. A pad in accordance with claim 9 wherein the pad has a moment of inertia which is less than 10.9 $mm^4$ per mm of distance across the pad surface.

11. A pad in accordance with claim 9 wherein the depth of the slits is at least 20% of said pad thickness.

12. A pad in accordance with claim 9 wherein the depth of the slits is at least 5% of said pad thickness.

13. A pad in accordance with claim 9 wherein spacing between slits is between 5 cm and 0.02 cm.

14. A pad in accordance with claim 9 wherein spacing between slits is random.

15. A pad in accordance with claim 9 wherein spacing between slits is periodic.

16. A pad in accordance with claim 9 wherein spacing between slits is aperiodic.

17. A method for polishing a workpiece comprising:

A. providing a polishing pad comprising an upper surface and lower surface, said surfaces substantially parallel to one another, having enhanced flexibility produced by scoring of said lower surface;

B. placing a polishing fluid into an interface between the workpiece and the upper surface of the pad, C. having said workpiece and said pad move in relation to one another thereby polishing the workpiece on the upper surface of the pad.

* * * * *